United States Patent [19]

Webber

[11] 4,232,415

[45] Nov. 11, 1980

[54] MATTRESS SLING

[76] Inventor: Gloria C. Webber, 44 Gail Dr., New Rochelle, N.Y. 10805

[21] Appl. No.: 21,913

[22] Filed: Mar. 19, 1979

[51] Int. Cl.[3] ..... A47C 21/08

[52] U.S. Cl. ..... 5/427; 5/512

[58] Field of Search ..... 5/425, 426, 427, 428, 5/429, 430, 424, 512, 98 R; 297/219, DIG. 6

[56] References Cited

U.S. PATENT DOCUMENTS

| | | | |
|---|---|---|---|
| 1,729,352 | 9/1929 | McGinnis et al. | 297/219 |
| 3,695,690 | 10/1972 | Carson | 297/219 |
| 3,742,530 | 7/1973 | Clark | 297/219 |

FOREIGN PATENT DOCUMENTS

| | | | |
|---|---|---|---|
| 160052 | 3/1921 | United Kingdom | 5/427 |

*Primary Examiner*—Roy D. Frazier
*Assistant Examiner*—Alexander Grosz
*Attorney, Agent, or Firm*—Paul R. Audet

[57] ABSTRACT

A mattress sling for a bed with side rails, comprised of a base portion to be positioned between a mattress and mattress support, and two spaced, opposed side portions made of a meshed material having releasable securing means for securing each side sheet to a side rail vertically removed from the mattress, to prevent injury to bed occupants by maintaining the mattress in bed alignment and closing off any gap between a side rail and the mattress or mattress support.

8 Claims, 6 Drawing Figures

MATTRESS SLING

BACKGROUND OF THE INVENTION

This invention relates to beds having side rails. More particularly, the invention is directed to a mattress sling for preventing injuries from occurring to bed occupants mainly because they or their appendages become lodged in a space or gap which exists or is created between the bed side rails and the bed mattress, or mattress support.

Hospitals, nursing homes, institutions and like patient care establishments utilize beds which typically have vertically movable side rails to prevent patients from falling out of beds, and to facilitate, for example, cleaning, removing and replacing bed sheets, mattressses and patients. When the side rails are raised and set in their normal working position, the lowermost side rails of even the best beds are in a horizontal position at or just above the upper plane of the mattress. In those instances where the lowermost side rail is above the plane of the mattress, even when the mattress is properly aligned, a hazardous space or gap exists between the mattress and lowermost side rail. Misalignment of the mattress increases the gap. When the lowermost side rail is at or below the upper plane of an aligned mattress, a hazardous gap is created by downward patient pressure on the mattress edge or by mattress misalignment.

It is too well known that because of these bed constructions and spaces or gaps, whether or not due to askew mattresses, bed occupants or patients who are asleep, cannot control or do not realize the significance of their movements, particularly the elderly, physically handicapped, mentally ill, restless or confused, often injure themselves when their bodies, arms, legs or chests become lodged between the bed side rails, or more commonly between a bed side rail and the bed, mattress or mattress support. Such patients needlessly suffer pressure marks, bruises, dislocated, fractured or broken bones, or still worse, as recently occurred in a well publicized successful 3.6 million dollar damage suit, due to head and neck lodgement, patients may lose conciousness and thereafter live in a permanent state of vegetation.

Heretofore, the only successful but often cruel and otherwise unnecessary means of preventing such injuries was to use straight jackets and other appendage restraint means and fasten these means to the beds.

It is a main object of this invention to provide means for preventing the above described and other injuries from occurring.

Another object of this invention is to provide a mattress sling for stabilizing and maintaining a mattress in proper position on a bed having side rails so that no gap or space can exist between lower bed side rails, and the bed, mattress, or mattress support.

Another object is to provide the above objectives while providing the bed occupant with freedom of movement, ventilation and visibility.

DETAILED DESCRIPTION OF THE DRAWINGS

Figure 1:
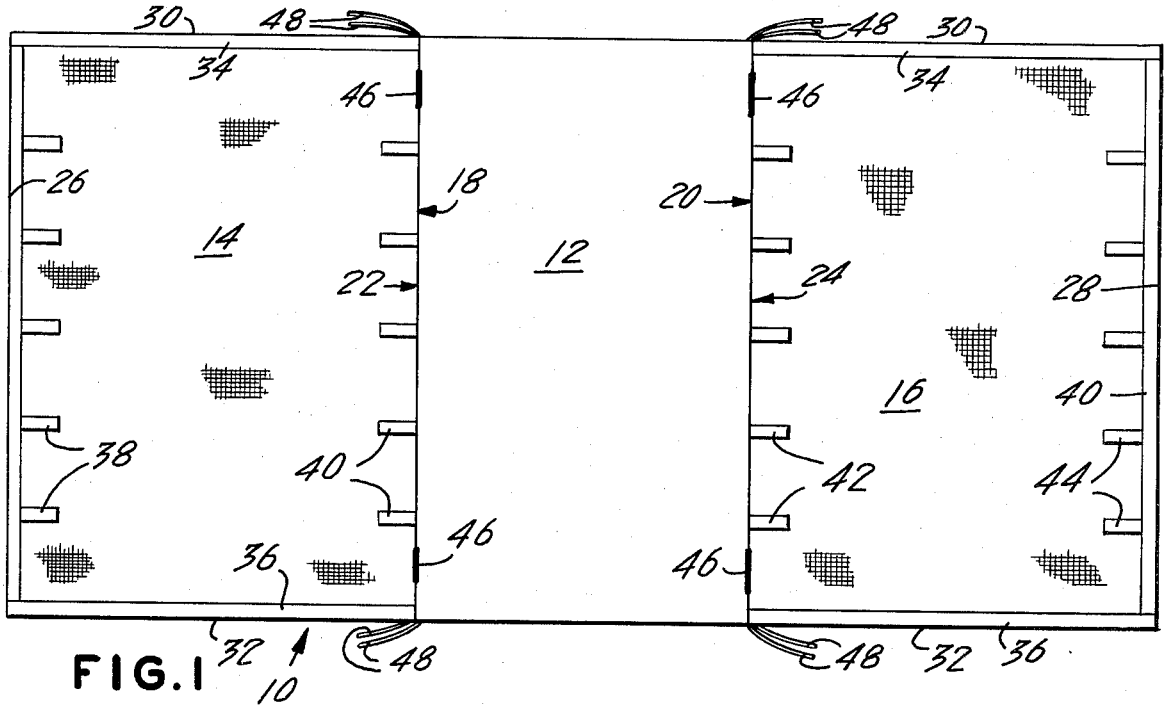
FIG. 1 is a plan view of a preferred embodiment of the mattress sling of this invention.

Referring to the drawings in detail, FIG. 1 shows a preferred embodiment of the mattress sling of this invention, generally designated 10, adapted for use with a bed having a mattress support and substantially horizontal side rails. Mattress sling 10 is comprised of a base portion or sheet 12 adapted to be positioned under a mattress between the mattress and the mattress support, and two spaced, side portions or sheets 14, 16. Although mattress sling 10 can be one piece, in the preferred embodiment shown, the mattress sling has three main pieces, base sheet 12 having opposed elongated edges 18, 20, and side sheets 14, 16, each having a longitudional proximate edge 22, 24 integral with, connected or attached along its length to respective adjacent base sheet enlongated edges 18, 20, longitudional remote edges 26, 28 opposite, removed from and substantially parallel to edges 22, 24, and head and foot edges, generally designated 30, 32 at the head and foot ends of each side sheet. Each side sheet also has connected or attached thereto, releasable securing means utilizable in association with one or more side rails for releasably securing itself to one or more side rails. The preferred securing means include pieces of adhesive material of any suitable size, shape or length connected or attached to the side sheets in any suitable manner in any suitable positions, preferably such that when a side sheet is extended upward and looped over and around a side rail vertically removed from the mattress, the pieces of each pair are juxtaposed and capable of mating and releasably securing the side sheet to or about the side rail. In the embodiment shown, the pieces of adhesive material include head and foot strips 34, 36 positioned along head and foot edges 30, 32, pairs of pieces 38, 40 respectively positioned adjacent and vertical to longitudional remote edges 26, 28 and pairs of pieces 42,44, respectively positioned adjacent and vertical to longitudional proximate edges 22, 24. The pieces of each pair are parallel to head and foot strips 34, 36. Should a mattress sling be desired which is suitable for use on numerous beds each having side rails of different heights, the pieces of adhesive material could each be elongated strips running parallel to head and foot strips 34, 36, from remote edges 26 and 28 to proximate edges 22 and 24.

All of the strips of pieces of adhesive material are attached to and have their adhesive, mating sides facing from the undersurface or rail facing surface of the side sheets (not shown in FIG. 1).

As shown in FIG. 1, mattress sling 10 also includes openings shown in the form of slits 46 near the head and foot ends of the mattress sling, adjacent and along the edges of the junction of or the seam formed by base sheet 12 and side sheets 14, 16, for passing patient care apparatus therethrough, and tying means shown in the form of pairs of strands 48 attached to the mattress sling at or adjacent each corner of base sheet 12 for tying the base sheet and the mattress sling to a bed or its mattress support, to prevent base sheet 12, mattress 64 thereon and mattress sling 10 from slipping relative to the mattress support, or from shifting out of its proper aligned position on the bed.

Figure 2:
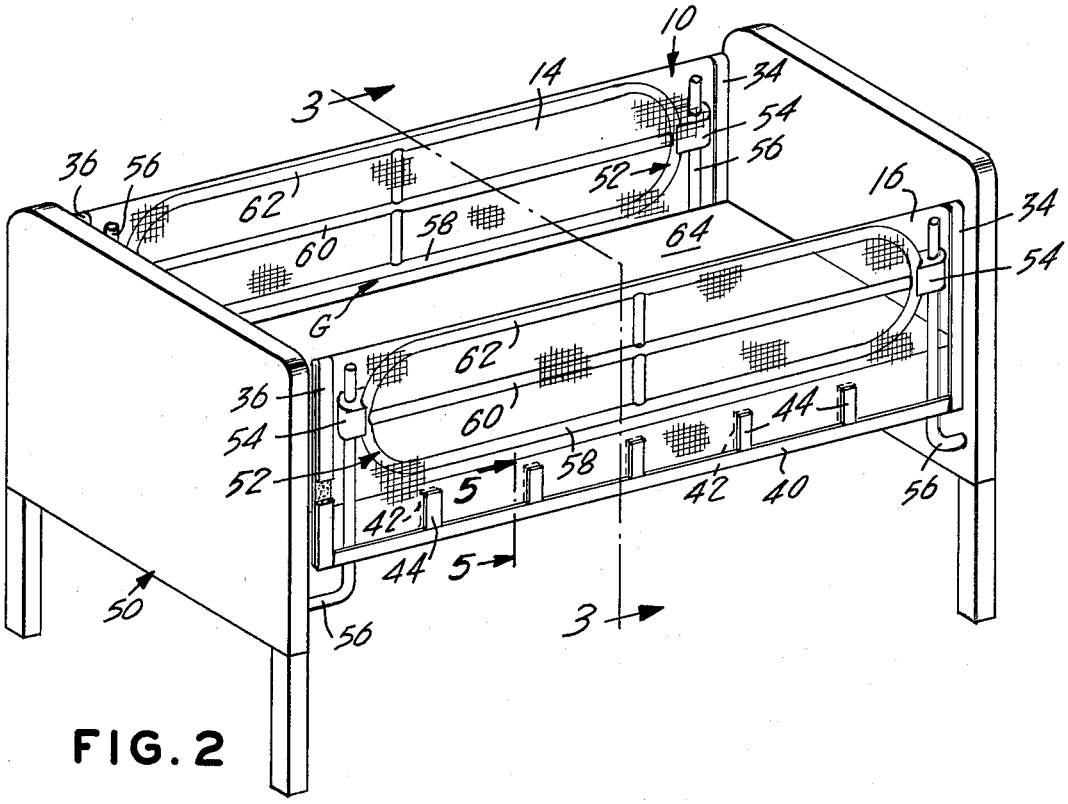
FIG. 2 is a perspective view of a conventional hospital bed having side rails and having a mattress sling secured thereto.
Figure 3:
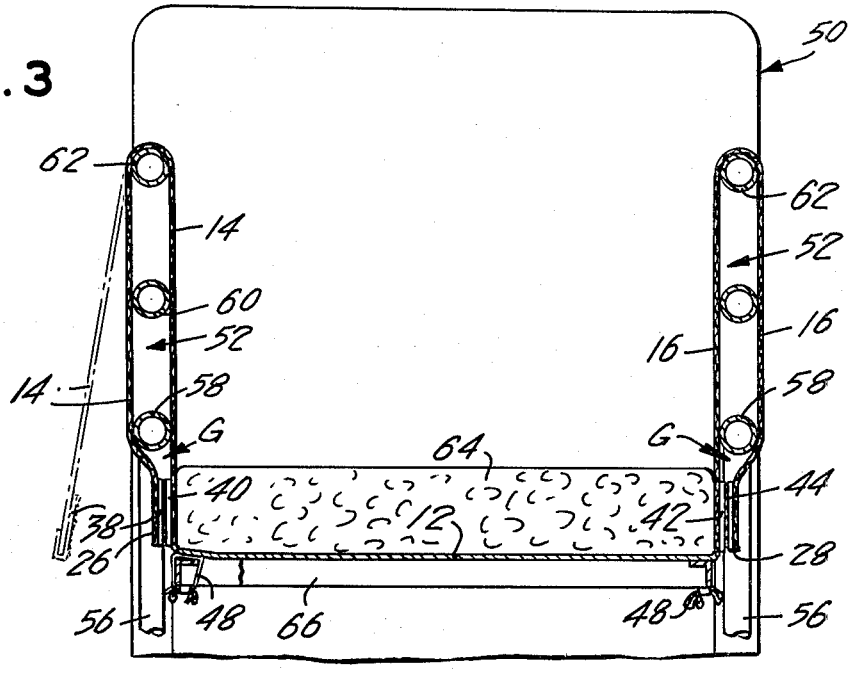
FIG. 3 is an enlarged fragmentary cross sectional view, with portions in perspective, taken substantially along line 3—3 of FIG. 2.

FIG. 2 is a perspective view showing mattress sling 10 in working position on a bed generally designated 50, which is typical of beds commonly used is hospitals, nursing homes and institutions, and which has side rail units 52, which, by means of their sleeves 54, vertically reciprocate on posts 56 near the head and foot ends of the bed. Each side rail unit 52 has one or more substantially horizontal side rails, here, 58, 60, 62, the lowermost of which is usually at or as shown, inches above the upper plane of mattress 64. Any space or gap G between mattress 64 and lowermost side rail 58 or between the side rail and mattress support 66 (FIGS. 3 and 4), whether due to construction of the bed or to an askew mattress, would allow the possibility of lodgement of the bed occupant or his or her appendage between side rail 58 and mattress 64 or mattress support 66. A possibility of lodgement also would exist due to the gaps between respective side rails 58, 60 and 62. However, as shown in FIGS. 2 and 3, such possibilities of lodgement are prevented by the mattress sling of this invention, whose respective side sheets 18, 20 each is of a longitudinal length greater than the distance between the posts and the head and foot ends of the bed, each extends substantially tautly both along substantially the length of mattress 64 and beyond the posts, substantially upward from adjacent the side of mattress 64, to and over a vertically upwardly removed side rail, here, uppermost side rail 62, and downward along the outside of the side rails to where the side sheets' respective pieces of adhesive material 38, 40 and 42, 44 are juxtaposed, mate and cooperatively secure each side sheet about the side rails to itself well below lowermost side rail 58, adjacent the side wall and bottom of mattress 64. FIG. 2 also shows each head and foot strip 34, 36 folded at about the middle of its length and secured to itself to cooperatively provide a vertical seal at the head and foot ends of each side sheet just beyond the ends of the side rails or the side rail units 52 between the posts and the head and foot ends of the bed, to thereby help secure the side sheets onto the side rail units, maintain side sheet horizontal tautness, and prevent longitudional movement or slippage of the side sheets and mattress sling relative to the side rail units and side rails. Head and foot strips 34, 36 and pieces 38, 40 and 42, 44 secure mattress sling 10 onto bed 50 and its side rails or units, and, aided by strands 48 tied about mattress support 66, they maintain mattress sling 10, and, more importantly, mattress 64, in proper position and alignment relative to bed 50, mattress support 66, side rail units 52 and its side rails, particularly lowermost side rail 58.

FIG. 3, an enlarged cross section taken along line 3—3 of FIG. 2, shows mattress sling 10 in working position holding mattress 64 in proper longitudionally aligned position. FIG. 3 clearly shows each side sheet 14, 16 extending tautly up and over side rail unit 52 and secured to itself adjacent and against the sides of mattress 64 by means of facing, mating and cooperatively secured pieces 38, 40 and 42, 44. FIG. 3 also clearly shows each side sheet 14, 16 extending tautly from adjacent the mattress bottom, along the insides of the side rails to and over side rail 62 to provide a one-piece, continuous barrier which effectively blocks or seals off any dangerous gap between the side rails, or between the side rails and mattress or mattress support. The broken away portion of FIG. 3 shows strands 48 tied to or about a frame member of for example a bed spring of mattress support 66.

Figure 4:
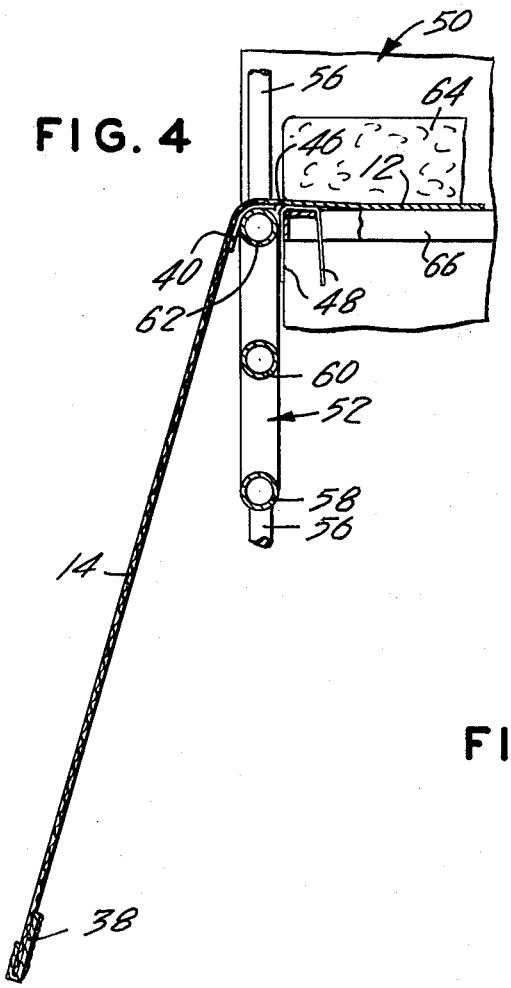
FIG. 4 is a fragmentary sectional view similar to FIG. 3, showing the mattress sling being placed on a bed with its side rails down.
Figure 5:
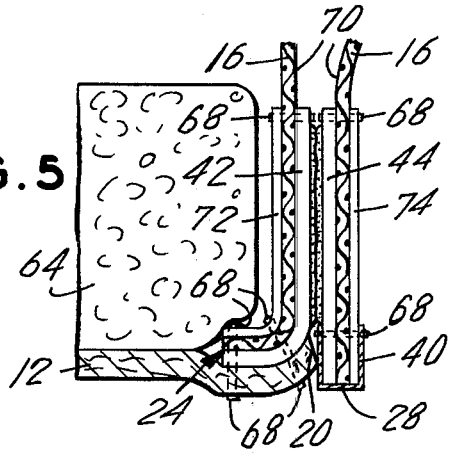
FIG. 5 is an enlarged detailed cross sectional view taken along line 5—5 of FIG. 2.
Figure 6:
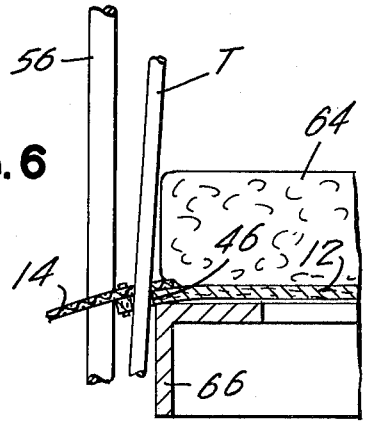
FIG. 6 is an enlarged fragmentary sectional view somewhat similar to that of FIG. 4.

A preferred manner of placing mattress sling 10 in working position on bed 50 can be explained in reference to FIGS. 3, 4 and 5. FIG. 4, a fragmentary cross section similar to a portion of the left side of FIG. 3 shows that with side rail unit 52 in its downwardly displaced position prior to mattress 68 being placed on bed 50, base sheet 12 of a mattress sling 10 of preselected size is placed squarely on mattress support 66 so that base sheet 12 and mattress support 66 are substantially fully aligned with each other. Each of the four sets of strands 48 (one set shown) is tied tightly about a suitable portion of the bed, for example the frame of the bed spring or mattress support 66. Side sheets 14, 16 are allowed to drape or hang over uppermost side rail 62. Mattress 64 is aligned with and placed in properly aligned position squarely and directly on base sheet 12. If desired, the bed occupant can be placed on the mattress and any patient care apparatus, such as a catheter drainage tube T (FIG. 6) can be passed through slit 46 for connection to the bed occupant. Slits 46 may be used for other purposes as well, for example to allow portions of straight jackets or wrist or ankle restraints to be secured to the bed or mattress support. As side rail unit 52 is lifted to and locked in its working, raised position, side sheet 14 is likewise raised and its more remote portion drapes or hangs over uppermost side rail 62 (dashed lines, FIG. 3). The side sheet is pulled tightly down over the uppermost side rail until pieces of adhesive material 38, 40 are roughly juxtaposed. Pieces 38, 40 of each pair are then aligned, brought together, mated and cooperatively secured to each other. Head strip 34 (not shown) is then secured to itself, and, after pulling side sheet 14 taut lengthwise, foot strip 36 is also mated and cooperatively secured to itself.

FIG. 5 is an enalrged detailed view of the lower right, mostly schematic, portion of FIG. 3 showing the manner in which pieces of adhesive material 42, 44 are secured to side sheet 16 and to one another. More particularly, FIG. 5 shows each piece 42 connected, attached or sewn to side sheet 16 by thread generally designated 68 which passes through each piece, through the netted, screen-like or meshed material, here designated 70, and through backing members 72, 74 positioned opposite pieces 42, 44 on the reverse, non-rail facing side of meshed material 70. Backing member 72, meshed material 70 and piece 42 are likewise attached to base sheet 12 by thread 68. The lower extremity of side sheet 16, longitudional remote edge 28, preferably is made of a band of cloth or like suitable material folded into a U-shape and sewn by thread 68 to hold the lower or remote edges of piece 44, meshed material 70 and backing member 74 together. Edge 28, lacking an exposed adhesive material surface, provides a readily accessible strip which can be easily gripped and lifted to separate pieces 42, 44 from each other.

Mattress sling 10 can be removed from bed 50 by reversing the steps just described. After head and foot strips 34, 36 are respectively disengaged, remote edges 26, 28 are lifted and pieces 38, 40 and 42, 44 are disengaged, side rail units 52 are lowered and tube T and mattress 64 are removed, strands 48 are untied and mattress sling 10 can be removed from the bed.

Mattress sling 10 can be made of any suitable material or materials. Most simply, it can be made of one continuous sheet or piece of material wherein the base and side sheets are made of one integral piece of meshed, netted or screen-like material, for example such as may be used for playpens. Preferably, mattress sling 10 is made of two or more different materials. Base sheet 12 is made of a washable canvas or like material. The base sheet need not be an integral, continuous sheet as shown, but it can be made in skeleton form. For example, it can have cutouts or openings therein or it could be made of individual straps attached or unattached to each other to conserve material. Basically, the base portion of sheet refers to that central portion of the sling which underlies the mattress or overlies the mattress support.

Side sheets 14, 16 preferably are made of a material capable of preventing a human appendage from passing therethrough under conditions encounterable in the bed environment. The material should allow air and light passage therethrough to permit proper bed occupant ventilation and observation. Desirably, the side sheets are made of a meshed or net-like plastic or polymeric material, such as nylon, and which is strong, durable and washable, and not coarse or abrasive to the bed occupant's skin. The mesh of the material should be tight to prevent fingers from being caught therein.

The releasable securing means can be any suitable means including various fasteners such as snaps, strands, straps, belts, buckles, spring clips, hooks and loops, tapes, etc., fastened, attached, glued or sewn to the side sheets for releasably securing the side sheets to themselves about a side rail, or for releasably securing the side sheets directly to a side rail or to another portion of the bed. Preferably, the securing means are as shown, pieces or strips of material made of any suitable material, one side of each piece or strip having an adhesive material, for example, cooperatively securing minute plastic hooks and loops such as a material sold under the trademark "Velcro". The securing means need not be positioned as shown. For example, side sheets 14, 16 could be shorter to extend any desired length, for example only up to any desired side rail in which case side sheets 14 and 16 could be shortened as desired, and straps could be attached to the side sheets along their edges to secure the sheets directly to the desired side rail. If the side sheet extends over the uppermost side rail and is secured to itself below that rail or the middle rail, the pairs of pieces 38, 40 and 42, 44 can be appropriately cooperatively positioned, although such an arrangement would position pieces 38, 40 at a mid-portion of the side sheet which might deleteriously affect bed occupant visibility.

It is thought that the invention and many of its attendant advantages will be understood from the foregoing description, and it is apparent that various changes may be made in the form, construction and arrangement of parts without departing from the spirit and scope of the invention or sacrificing all of its material advantages, the articles herein before described being merely preferred embodiments thereof.

What is claimed is:

1. A mattress sling for use with a bed having head and foot ends, a mattress support, and substantially horizontal side rails which reciprocate on posts, comprised of:

a base portion adapted to be positioned under a mattress between the mattress and the mattress support, and two spaced, opposed side portions each (i) having longitudinal proximate edges connected to the base portion, (ii) having head and foot edges and a longitudinal remote edge, (iii) being of a longitudinal length greater than the distance between the posts on which the side rails are mounted such that the head and foot edges are positionable between the posts and the head and foot ends of the bed, and being of a vertical length such that the longitudinal remote edge is positionable below the lowermost side rail, and (iv) having attached thereto releasable securing means in the form of a strip of adhesive material along each head and foot edge, and pieces of pairs of adhesive material positioned adjacent its longitudinal proximate edge and its longitudinal remote edge, for releasably securing each side portion to itself about the side rails so that when a mattress is on the base portion, each secured side portion extends substantially tautly and substantially vertically upward from adjacent the side of the mattress to and over a side rail most vertically removed from the mattress, and downward such that the pairs of pieces of adhesive material are releasably secured to each other vertically below the lowermost side rail, adjacent the side wall and bottom of the mattress, and the strips of adhesive material are secured to each other along the head and foot edges between the posts and the head and foot ends of the bed, to thereby prevent the mattress from shifting out of its proper position of the mattress support, and prevent the bed occupant or his or her appendage from becoming lodged between the lowermost side rail and the mattress or mattress support.

2. The mattress sling of claim 1, wherein the side portions are made of meshed material which permits air and light therethrough for ventilation and visibility of the bed occupant.

3. The mattress sling of claim 2 wherein there is included tying means for tying the mattress sling to the bed to prevent slippage of the mattress sling relative to the mattress support.

4. The mattress sling of claim 2 wherein the mattress sling includes openings therein for the passage therethrough of patient care apparatus.

5. The mattress sling of claim 1, wherein there is included tying means for tying the mattress sling to the bed to prevent slippage of the mattress sling relative to the mattress support.

6. The mattress sling of claim 5 wherein the tying means are pairs of strands attached to the mattress sling adjacent each corner of the base portion for tying the base portion to the bed.

7. The mattress sling of claim 1, wherein the mattress sling includes openings therein for the passage therethrough of patient care apparatus.

8. The mattress sling of claim 7 wherein the openings are located adjacent the junction of the base portion and each side portion.

* * * * *